US006367130B1

(12) United States Patent
Duval et al.

(10) Patent No.: US 6,367,130 B1
(45) Date of Patent: Apr. 9, 2002

(54) SMOOTH-TABLE CIRCULAR NEEDLING MACHINE

(75) Inventors: Renaud Duval, Les Cheres; Thierry Marjollet, Besancon; Robert Jean, Fouqueville, all of (FR)

(73) Assignee: Messier-Bugatti, Velizy-Villacoublay (FR)

( * ) Notice: Subject to any disclaimer, the term of this patent is extended or adjusted under 35 U.S.C. 154(b) by 0 days.

(21) Appl. No.: 09/900,260

(22) Filed: Jul. 6, 2001

(30) Foreign Application Priority Data

Apr. 30, 2001 (FR) ..... 01 05798

(51) Int. Cl.[7] ..... D04H 18/00
(52) U.S. Cl. ..... 28/107
(58) Field of Search ..... 28/107, 108, 109, 28/110, 111, 112, 113, 114, 115

(56) References Cited

U.S. PATENT DOCUMENTS 5,664,305 A * 9/1997 Lawton et al. ..... 28/107
6,009,605 A * 7/2000 Olry et al. ..... 28/107
6,183,583 B1 * 2/2001 Duval et al. ..... 28/107
6,237,203 B1 * 5/2001 Sheehan et al. ..... 28/107
6,248,417 B1 * 6/2001 Ponsolle et al. ..... 28/107

FOREIGN PATENT DOCUMENTS

| | | |
|---|---|---|
| EP | 0 232 059 A2 | 8/1987 |
| EP | 0 849 389 A1 | 6/1998 |
| FR | 2 626 294 | 7/1989 |

* cited by examiner

*Primary Examiner*—Danny Worrell
(74) *Attorney, Agent, or Firm*—Weingarten, Schurgin, Gagnebin & Lebovici LLP

(57) ABSTRACT

In a circular needling machine for needling an annular preform and comprising both a vertically movable needling table serving as a horizontal support for said annular preform, and a needling head having a determined number of barbed needles disposed over the needling table in a needling zone and driven with vertical reciprocating motion, provision is made for the annular preform to be placed directly on the needling table and for it to be driven in rotation on the needling table by drive means while the needling table remains rotationally stationary during said rotation. The drive means comprise a set of conical friction rollers kept continuously in contact with the annular preform.

13 Claims, 2 Drawing Sheets

SMOOTH-TABLE CIRCULAR NEEDLING MACHINE

FIELD OF THE INVENTION

The present invention relates to the field of needled textile structures and it relates more particularly to a needling machine of the circular type.

PRIOR ART

Circular type needling machines are now well known, as shown for example by patent applications FR 2 626 294 or EP 0 849 389. In those conventional machines, the textile structure is needled by relative angular rotation between a horizontal platen supporting the structure and a needling head performing vertical reciprocating motion. In general, because of the reciprocating motion of the head, it is the support platen which rotates and it is the needling head which does not rotate. Furthermore, in order to keep the preform on the platen during rotation and in order to guarantee that it is properly held down, the platen is covered in a material that allows needling to take place, such as a succession of polypropylene fiber felts interconnected by adhesive or stitching (see for example application EP 0 232 059) or a set of brush mats (EP 0 849 389).

That circular machine configuration with a brush (or felt) platen unfortunately presents numerous drawbacks. Firstly the difficulty in securing the first layers of the preform generally makes it necessary to perform over-needling on them, which not only modifies needling density in the preform in said first layers, but also raises a problem when the preform is to be removed, since it must then be torn away from the brush or taken away together with the felt. Further, when the fibers for needling are of a brittle type such as carbon fibers, a particularly large amount of pollution is produced in the brush, which must be cleaned frequently in order to avoid the machine becoming dirtied to an extent that is harmful to making preforms. Finally, the flexibility provided by the presence of a brush or a belt, whereby the brush or felt is compressed to an increasing extent with increasing thickness of the preform, means that it is not possible to know the exact position of the top surface of the preform, and thus that it is not possible to have full control over needle penetration.

OBJECT AND DEFINITION OF THE INVENTION

The present invention thus proposes mitigating these drawbacks with a circular needling machine of a novel type enabling annular preforms to be made having a structure that is particularly homogeneous. An object of the invention is also to propose a machine that is well adapted to needling textile structures made of brittle fibers, and in particular carbon fibers.

These objects are achieved by a circular needling machine for needling an annular preform made from a fiber fabric of material to be needled, the machine comprising a vertically movable needling table serving as a horizontal support for said annular preform, and a needling head comprising a determined number of barbed needles overlying a needling zone of said needling table and driven with vertical reciprocating motion, wherein said annular preform is placed directly on said needling table and is driven in rotation on said needling table by drive means, said needling table remaining rotationally stationary during said rotation.

This revolutionary structure for a circular needling machine using a platen or table that is "smooth" makes it possible to provide annular preforms presenting needling density that is uniform throughout the thickness of the preform and in which the various layers are of constant thickness.

In a preferred embodiment, the drive means for the annular preform comprise a set of conical friction rollers kept continuously in contact with said annular preform. Preferably, said set of conical friction rollers comprises three rollers advantageously disposed at 120° and each actuated by an independent motor and gear box unit.

The needling table comprises a plurality of localized perforations for receiving said barbed needles during the first needling passes and it is preferably coated in an anti-friction material.

In an advantageous embodiment that is more particularly suitable for making preforms out of brittle fibers, the needling table forms the top wall of a suction box for removing fiber residues.

The needling machine of the invention can further comprise at least one conical backing roller placed in an opening in said needling table and designed to cooperate with at least one of said conical drive rollers. Preferably, said conical backing roller is mounted idle.

The present invention also provides the needling method implemented in the above-specified circular needling machine.

BRIEF DESCRIPTION OF THE DRAWINGS

The characteristics and advantages of the present invention appear more clearly from the following description given by way of non-limiting indication and with reference to the accompanying drawings, in which.

DETAILED DESCRIPTION OF A PREFERRED EMBODIMENT

Figure 1:
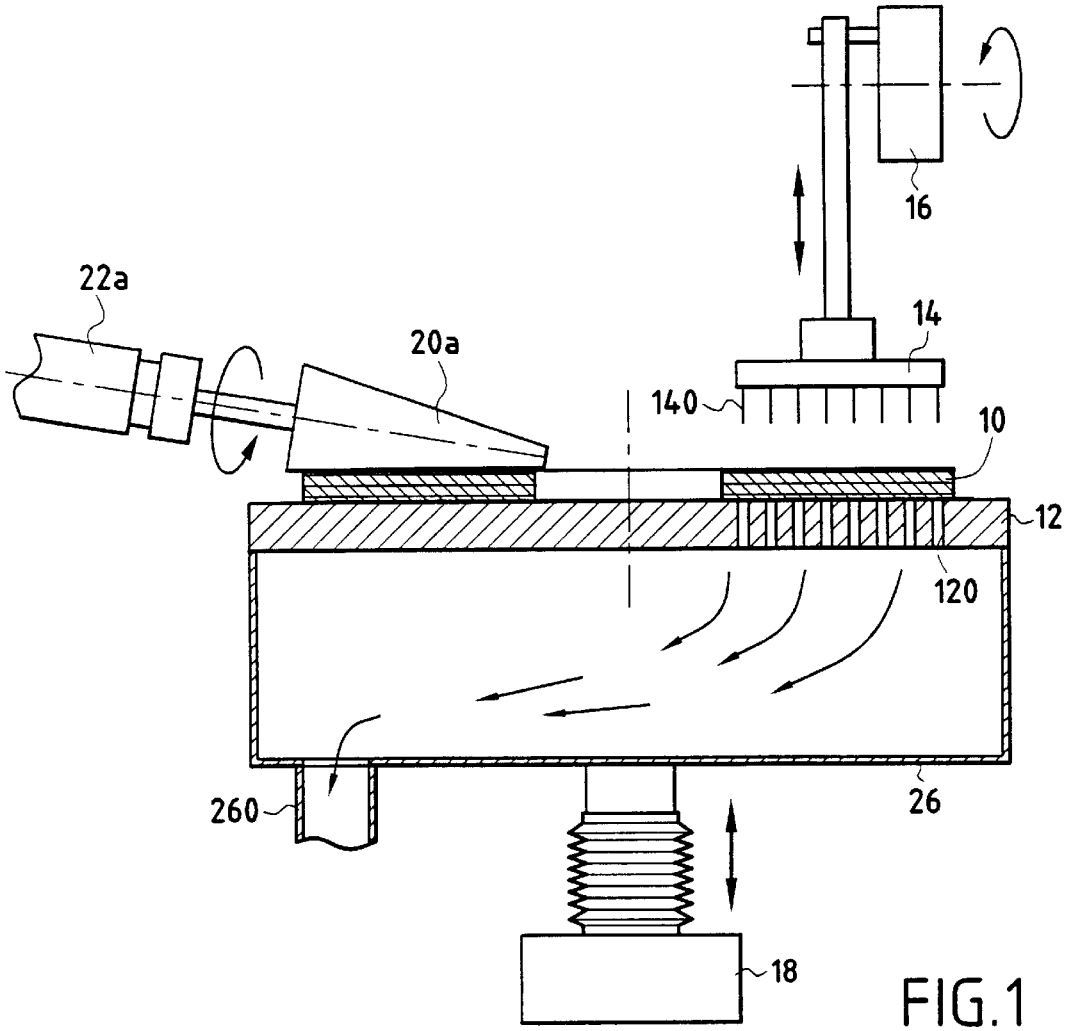
FIG. 1 is a diagrammatic elevation view of a circular needling machine of the invention.

A circular needling machine of the invention is shown in FIG. 1 in highly diagrammatic manner.

Conventionally, in a circular needling process, annular textile layers or plies are stacked and needled together on a platen to form a needled fiber preform of annular shape. The plies can be previously formed as rings or juxtaposed ring sectors cut out from a woven or non-woven fabric of unidirectional or multidirectional fibers. They can also be formed by winding turns flat from a feeder device of the kind described in the patent application filed on the same day as the present application, assigned to the same Assignee, and entitled "Feeding a needling machine with a continuous spiral strip", or turns formed from deformed braid, or indeed turns formed from a deformable two-dimensional fabric.

The annular preform 10 which can in particular constitute a preform for a brake disk of composite material, rests directly on a platen 12 forming a needling table. It is rotated and passes through a needling station comprising a needle board 14 which overlies a determined sector of the needling table (with the location of the sector being represented by chain-dotted lines in FIG. 2).

The needle board is driven with reciprocating motion in a direction that extends transversely relative to the platen by means of a crank and connecting rod type drive device 16. The needles 140 carried by the needle board are fitted with barbs, hooks, or forks so as to take fibers from the stacked plies and transfer them as they penetrate through the annular preform. The needling table 12 has a series of perforations 120 occupying the same area as the needle board and located in register with each needle so that the needles can pass into the perforations while needling the initial plies of the annular preform. For needling each new textile ply, the needling table may be moved vertically by motor means 18 through a down step of determined size corresponding for example to the thickness of one needled ply.

Figure 2:
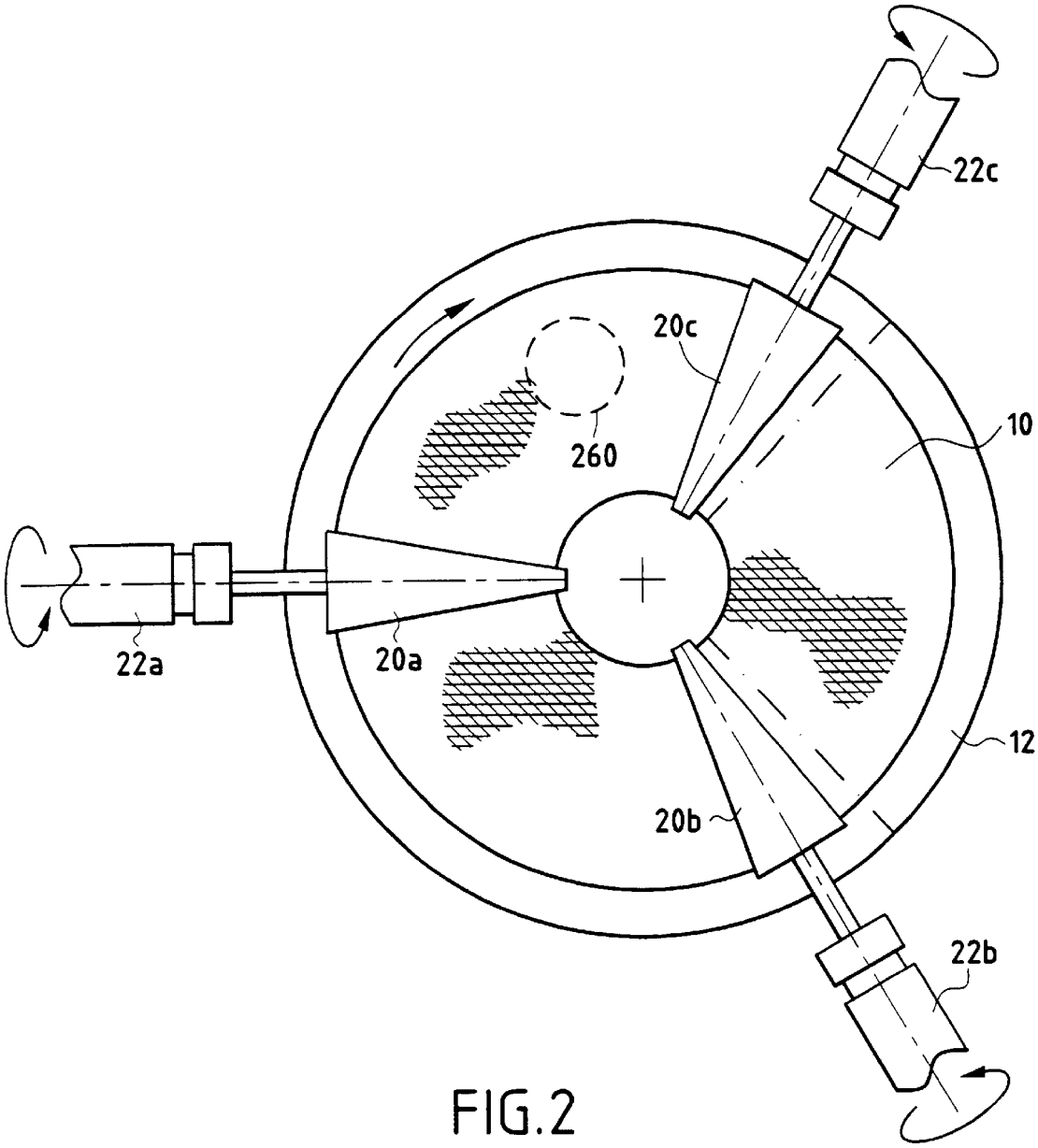
FIG. 2 is a plan view of the circular needling machine of FIG. 1 showing the means for driving the textile structure to be needled.

In the invention, and as shown in FIG. 2, the annular preform 10 is rotated by means of a set of conical rollers 20*a*, 20*b*, 20*c* coated in friction material, such as polyurethane or any other synthetic rubber, and kept continuously in contact with the annular preform. This set of rollers preferably comprises three conical friction rollers having axes angularly spaced by 120° and each driven by an independent motor and gear box unit 22*a*, 22*b*, 22*c*. Nevertheless, common drive means coupled to an appropriate transmission could naturally also be envisaged.

With this particular configuration in which the annular preform rests directly on the needling table (i.e. without any intermediate element), the problem posed by removing the preform which in the prior art requires the preform to be torn from the brush mat or polypropylene fiber felt previously secured to the needling table is now easily resolved. In a patent application entitled "A circular needling machine provided with a device for automatically removing preforms", filed on the same day as the present application and assigned to the same assignee, a device is described for removing preforms that is particularly adapted to such a circular needling machine configuration which can be referred to as a "smooth" table or platen machine. This facility for sliding on the table can be improved by covering the table in an anti-friction material such as Teflon®. Furthermore, the difficulty in securing the first layers in prior art needling machines which necessarily involve over-needling these first layers, is also eliminated.

Figure 3:
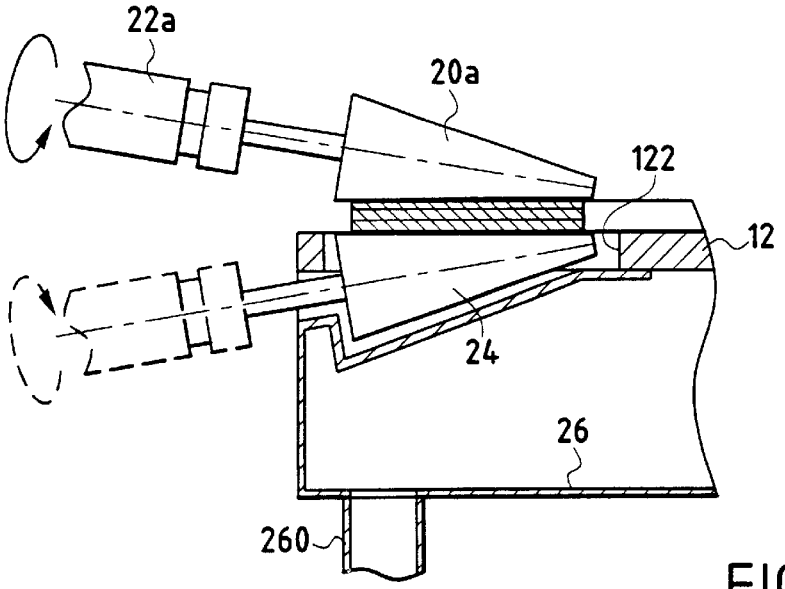
FIG. 3 shows a variant embodiment of the means for driving the textile structure to be needled.

In a variant embodiment shown in FIG. 3, the drive means further include at least one conical backing roller 24 which is preferably mounted idle, and located in an opening 122 in the needling table 12 in register with a conical drive roller (e.g. 20*a*) with which it cooperates. In a variant, the backing roller can also be driven at the same speed as the facing presser drive roller. This disposition in which the annular preform is sandwiched between a (driven) presser roller and a backing roller (which can be idle or optionally driven) provides better drive, particularly when the diameter of the preform is large. Furthermore, with very large diameters, it can also be advantageous to associate a backing roller with each of the drive rollers.

When the annular preform 10 is made using carbon fibers, it is advantageous during needling to suck away fiber residues. This type of fiber is brittle and generates a large amount of residue which needs to be removed in order to avoid dirtying the machine. For this purpose, the perforated needling table 12 is placed on a suction box 26 and forms the top wall thereof, while the bottom wall of the box is provided with a removal orifice 260 connected to a conventional suction device (not shown) for collecting the fiber residue that has been sucked into the box. In this use, and when present, the backing roller(s) placed in one or more corresponding openings in the needling table are naturally covered in leakproof manner relative to the suction device.

With the present invention, the numerous drawbacks that result from using a turning platen covered in a brush mat or in layers of felt are eliminated: the difficulty of securing the first plies is eliminated, the difficulty of removing the needled preform is also eliminated, and above all there is no longer any imprecision concerning the exact position of the top surface of the preform due to the brush or the felt buckling as needling progresses. Accurate knowledge of this position is necessary to ensure good control over needle penetration and is essential in the needling process to guarantee that annular preforms are made with uniform dimensional characteristics, as described in French patent application filed under No. 01/02869 in the name of the present Assignee and entitled "A needling machine provided with a penetration-measuring device".

What is claimed is:

1. A circular needling machine for needling an annular preform made from a fiber fabric of material to be needled, the machine comprising a vertically movable needling table serving as a horizontal support for said annular preform, and a needling head comprising a determined number of barbed needles overlying a needling zone of said needling table and driven with vertical reciprocating motion, wherein said annular preform is placed directly on said needling table and is driven in rotation on said needling table by drive means, said needling table remaining rotationally stationary during said rotation.

2. A circular needling machine according to claim 1, wherein said drive means for the annular preform comprise a set of conical friction rollers kept continuously in contact with said annular preform.

3. A circular needling machine according to claim 2, wherein said set of conical friction rollers comprises three rollers mutually disposed at about 120°.

4. A circular needling machine according to claim 3, wherein each of said conical friction rollers is actuated by an independent motor and gear box unit.

5. A circular needling machine according to claim 1, wherein said needling table comprises a plurality of localized perforations for receiving said barbed needles during the first needling passes.

6. A circular needling machine according to claim 1, wherein said needling table is coated in an anti-friction material.

7. A circular needling machine according to claim 1, wherein said needling table forms the top wall of a suction box for removing fiber residues.

8. A circular needling machine according to claim 2, further comprising at least one conical backing roller placed in an opening in said needling table and designed to co-operate with at least one of said conical drive rollers.

9. A circular needling machine according to claim 8, wherein said conical backing roller is mounted idle.

10. A method of circularly needling an annular preform, the method being of the type using a vertically movable needling table serving as a horizontal support for said annular preform and a needling head having a determined number of barbed needles occupying a needling zone over said needling table and driven with vertical reciprocating motion, in which method said annular preform is placed directly on said needling table and is driven in rotation by drive means with said needling table remaining rotationally stationary during said rotation.

11. A needling method according to claim 10, wherein said drive means for driving the annular preform comprise a set of conical friction rollers kept continuously in contact with the annular preform.

12. A needling method according to claim 11, wherein said set of conical friction rollers comprises three rollers mutually disposed at about 120°.

13. A needling method according to claim 10, wherein said needling table is coated in an anti-friction material.

* * * * *